US009698518B1

(12) United States Patent
King, Jr. et al.

(10) Patent No.: US 9,698,518 B1
(45) Date of Patent: Jul. 4, 2017

(54) WIRE CONNECTORS AND WIRE CONNECTOR KITS

(71) Applicants: L. Herbert King, Jr., Jupiter, FL (US); James C Keeven, O'Fallon, MO (US)

(72) Inventors: L. Herbert King, Jr., Jupiter, FL (US); James C Keeven, O'Fallon, MO (US)

(73) Assignee: THE PATENT STORE LLC, O'Fallon, MO (US)

( * ) Notice: Subject to any disclaimer, the term of this patent is extended or adjusted under 35 U.S.C. 154(b) by 0 days.

(21) Appl. No.: 14/544,281

(22) Filed: Dec. 18, 2014

Related U.S. Application Data

(60) Provisional application No. 61/966,650, filed on Feb. 27, 2014.

(51) Int. Cl.
*H01R 4/22* (2006.01)
*H01R 13/52* (2006.01)
*H01R 43/00* (2006.01)

(52) U.S. Cl.
CPC ..... *H01R 13/5216* (2013.01); *H01R 4/22* (2013.01); *H01R 43/005* (2013.01)

(58) Field of Classification Search
CPC ... H01R 4/00; H01R 4/22; H01R 4/12; H01R 4/07; H02G 3/16; H02G 3/16
USPC ..... 174/87, 84 R
See application file for complete search history.

(56) References Cited

U.S. PATENT DOCUMENTS 5,151,239 A * 9/1992 King, Jr. ..... H01R 4/22 174/87
5,531,618 A * 7/1996 Market ..... H01R 4/22 174/87
5,589,666 A * 12/1996 DeCarlo ..... H02G 1/14 156/48
5,922,994 A * 7/1999 Robinson, Sr. ..... H01R 4/22 174/87
6,958,449 B1 * 10/2005 Ziebart ..... H01R 4/12 174/84 R
8,552,296 B2 * 10/2013 Joye ..... H01R 4/20 174/87

* cited by examiner

*Primary Examiner* — Hien Vu
(74) *Attorney, Agent, or Firm* — Jacobson & Johnson

(57) ABSTRACT

A wire connector kit and a method of protecting an electrical connection comprising a wire connector and a source of expandable sealant wherein the expandable sealant is injected into a wire connector after the electrical connection has been formed with the expandable sealant undergoing an in situ internal expansion from a site proximate the electrical connection to encapsulate and protect the electrical junction from the environment or through forming a sealant plug in a housing through an in situ expansion of the sealant plug to protect an electrical connection cocooned within the housing by the sealant plug.

8 Claims, 6 Drawing Sheets

WIRE CONNECTORS AND WIRE CONNECTOR KITS

CROSS REFERENCE TO RELATED APPLICATIONS

This application claims priority from provisional application 61/966,650 filed Feb. 27, 2014.

STATEMENT REGARDING FEDERALLY SPONSORED RESEARCH OR DEVELOPMENT

None

REFERENCE TO A MICROFICHE APPENDIX

None

BACKGROUND OF THE INVENTION

A number of methods are available for sealing or waterproofing electrical connections either when the electrical connection is being formed or after the electrical connection has been formed. In one type of waterproofing an electrician forms the electrical connection in a viscous sealant located in a twist-on wire connector by twisting the wires in relation to the housing of the twist-on wire connector. In another type the sealant is poured into the connector until the sealant covers the electrical connection therein. In still other types of connectors an epoxy, which is poured into the wire connector, is allowed to cure around the wires in the wire connector.

In the sealant containing wire connectors a waterproof sealant, which is located in a central cavity of the twist-on wire connector, provides a waterproof covering over the electrical junction between a set of bared wire ends located therein. In twist-on wire connectors the wires are typically inserted through a pierceable cover and into a viscous sealant contained in a wire cavity of the twist-on wire connector. The housing is then twisted with respect to the wires to bring the bared ends of the wires into electrical contact with each other in the presence of the sealant, which forms a sealant air interface on the wire end of the connector to shield the electrical connection from the environment. In some twist-on wire connector sleeves are placed on the twist-on wire connector to contain extra sealant. In other embodiments the twist-on wire connector includes clips for looping the wires thereon to prevent the wires from pulling out of the twist-on wire connector. Examples of electrical twist-on wire connectors where the electrical connection is formed in the presence of the viscous sealant can be found in U.S. Pat. Nos. 5,113,037; 5,023,402 and 5,151,239.

Another example of a sealant containing wire connector is shown in King U.S. Pat. No. 8,431,824 for a direct bury splice kit where a twist-on wire connector is formed as an integral part of an elongated tube with the tube containing a viscous sealant to enable the formation of a sealant covered wire connection in one continuous action.

In another example an electrical connection is formed in an electrical connector, which is free of sealant. Once an electrical connection is formed the electrical connector is immersed into a sealant, which is contained in a tube or the like. This type of connector and method is shown in Fox U.S. Pat. No. 4,839,473 and King et al U.S. Pat. Nos. 7,170,005; 7,763,801 and 8,431,824. In both the Fox patent and the King patents the electrical connection is formed in a twist-on wire connector that is free of any sealant. After the electrical connection is formed the twist-on wire connector is immersed into a body of sealant to form a waterproof covering over the wire connector, which contains the electrical connection.

In still other methods the wires are secured within a wire connector through a sealant that hardens such as an epoxy. This type of securement of an electrical junction is shown in Spiteri U.S. Pat. No. 5,315,066 where a two-part epoxy within the wire connector is mixed within the wire connector and then allowed to set around the wires to lock the wires in place.

While the above methods may provide effective protection including waterproofing there are times when the above methods and sealants may not adequately protect the electrical connection since the configuration of the electrical wire connection may prevent the sealant from covering the electrical wire connection because the sealant viscosity and gravitational forces acting on the sealant are insufficient to bring the sealant into a sealing condition around the electrical wires, which can result in electrical failure.

SUMMARY OF THE INVENTION

Briefly, the invention comprises a method and kit for delivery of a two phase sealant comprising an expandable electrically insulative sealant, which is delivered in an unexpanded state, into an interior chamber of a wire connector after the formation of an electrical junction in the wire connector. The electrically insulative expandable sealant in a first unexpanded state and typically a liquid state is delivered to a region proximate an electrical junction where a phase change occurs through an in situ internal expansion of the electrically insulative expandable sealant from a liquid covering to a rigid covering.

As the sealant changes phase it generates internal expansion forces within the sealant that both encapsulate the electrical junction as well as fills any fissures or gaps between the wires forming the electrical junction. The delivery of a sealant in a first phase to the electrical connection results in an internal radially sealant expansion that progresses outward and inward from the electrical junction. The delivery of an unexpanded sealant to the electrical junction produces an in situ protective covering around the electrical wires as well as around the electrical junction. The in situ covering provides enhanced electrical junction isolation and external protection as the expanded sealant protects the electrical junction from the environment as well as electrically insulating the wire connection to prevent accidental contact with the electrical junction. The internal expansion pressure of the expanding sealant during the phase change fills gaps around an electrical wire connection, which may not be filled by other types of sealants. Consequently, other types of sealants, which remain in the same phase, lack the ability to generate an expansion force to bring the sealant into intimate contact with the wires in the electrical connection.

In one example an electrical wire connector includes at least two ports spaced from each other to allow air in the wire connector to escape from one port as the expandable sealant is injected through the other port. Once delivered to a region proximate the electrical connection the in situ expanding sealant expands internally to encapsulate the electrical junction within the electrical connector to form a protective or waterproofed electrical connection within the electrical connector.

The invention further includes a method of waterproofing an electrical connection by forming an electrical connection within an electrical connector that includes a housing that at least partially shields the electrical connection from the environment with the housing having a wire port on a first side of an electrical junction and an inlet port on another side of the electrical junction for injecting an expandable electrically insulative sealant through the inlet port and into proximity of the electrical connection where an internal in situ expansion of the electrically insulative sealant encapsulates the electrical connection as the expanding sealant expands radially outward from the interior of the wire connector. In this type of electrical connection encapsulation the internal expansion of the expandable sealant allows air to escape through gaps proximate the wire ports as the internally expanding sealant fills the chamber containing the electrical connection with an electrically insulative sealant. Once expanded, the sealant solidifies to a rigid or semi-rigid state that provides not only a sealant covering around the electrical connection but also a cushion to the wires held within the wire connector since the expanded sealant protects the wires from the environmental forces without the rigidity problems of a solidified connection such as soldered or epoxied connection.

In another example the expandable sealant may be used to form a sealant plug in a tube carrying a wire connector since the expansion of the sealant during the phase change can be used to frictionally and adhesively bind the sealant plug to the tube and to electrical wires extending through the sealant plug.

DESCRIPTION OF THE PREFERRED EMBODIMENT

Figure 1:
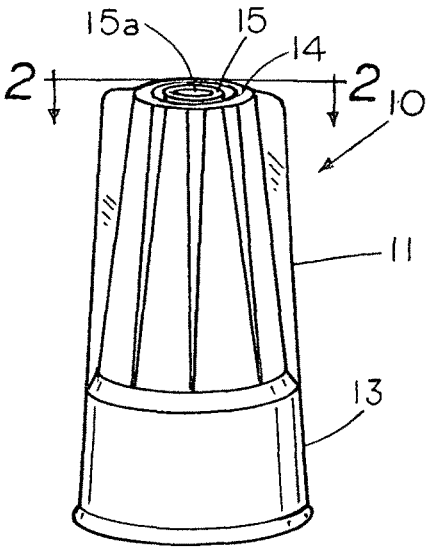
FIG. 1 is a perspective view of a twist-on wire connector having an end port for insertion of an expandable sealant.

FIG. 1 shows a perspective view of a twist-on wire connector 10 having an electrically insulated housing 11 with an annular base 13. Located on a normally closed end 14 of the twist-on wire connector 10 is a cylindrical lip 15, which is formed in the end of the housing 11 as an integral feature of the wire connector, creating a pipe nipple for attachment thereto with the pipe nipple 15 having a central passage 15*a* or end inlet port therein that extends through the normally closed end 14 of the twist-on wire connector 10 and into a wire cavity within the wire connector 10.

Figure 2:
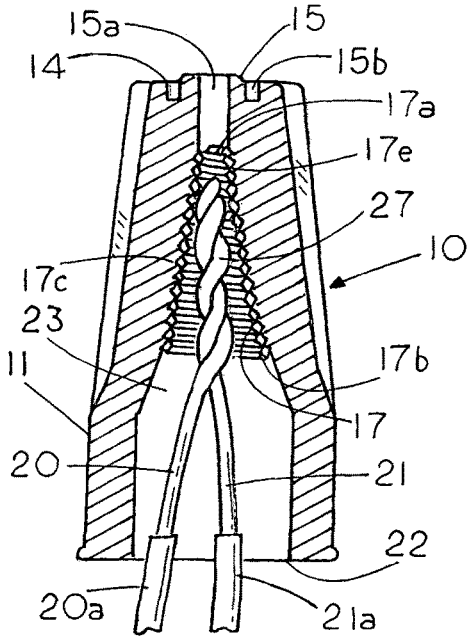
FIG. 2 is a cross section taken along lines 2-2 of FIG. 1.

FIG. 2 shows a cross sectional view of the twist-on wire connector of FIG. 1 revealing a spiral member 17 having an open apex end 17*e* with the spiral member containing a set of spiral ridges 17*c* for engaging a first electrical wire 20 having a partial electrical insulation covering 20*a* and a second electrical wire 21 having a partial electrical insulation covering 21*a*. The bared wire 20 and bared wire 21 extend into an open or wire end 22 of connector 10 and into the cavity 23. In the absence of any sealant in the wire connector the bared ends 20 and 21 have been formed into an electrical connection 27 in spiral member 17 by twisting the electrical insulated housing 11 with one hand while holding wires 20*a* and 21*a* with the other hand. After formation of the electrical connection 27 an expandable sealant is injected into to the cavity 23 in the wire connector, however, instead of injecting the expandable sealant into the wire end 22 of the wire connector the expandable sealant is injected into the end port 15*a*. In this example the inclusion of the pipe nipple 15 in the closed end of twist-on wire connector 10 enables one to inject the expandable sealant into the normally closed end of the wire connector creating an in situ internal expansion of the sealant proximate the electrical connection 27 without the concern for problems that may occur with injecting sealant into the open end of the wire connector for example, exposed wires within the wire connector. The presence of ports on opposite sides of the wire connection enables air to escape from within the wire connector as the sealant expands and cures. In the example shown in FIG. 2 the expandable sealant is injected through an inlet port containing no wires but in some cases one may elect to insert the expandable sealant into an open wire end of the wire connector.

FIG. 2 shows the normally closed end 14 of twist-on wire connector includes pipe nipple 15 which is integrally formed in the insulated housing of the normally closed end of twist-on wire connector 10 by forming an annular recess 15*b* in the end of the wire connector with a central passage or inlet port 15*a* located within the annular recess. Pipe nipple 15 provides for engagement with a source of unexpanded sealant while injection port 15*a* provides a passage for injecting an expandable sealant from a region outside of the twist-on wire connector 10 into the apex open end 17*e* and into a cavity or chamber 23 which flares outward to become larger toward the wire end 22 of the twist-on wire connector.

Figure 3:
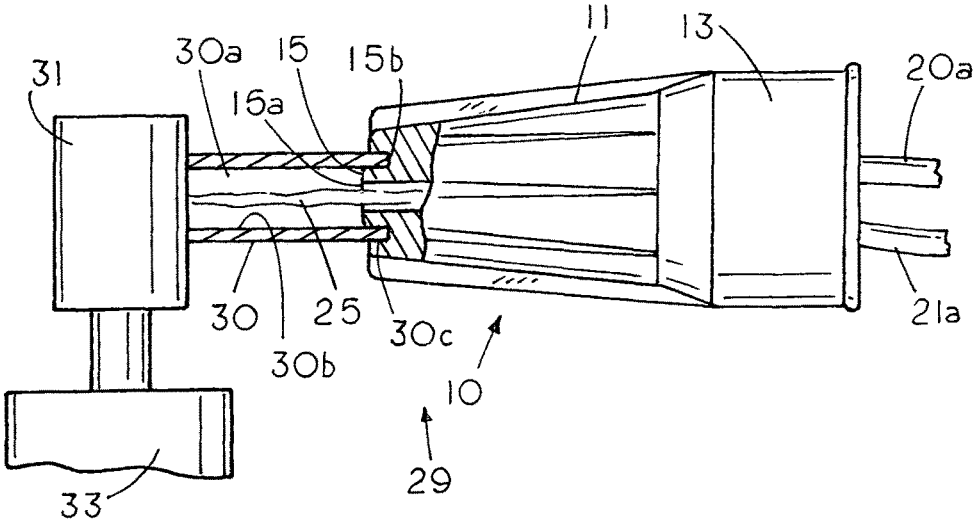
FIG. 3 is a partial sectional view showing the insertion of an expandable sealant into a twist-on wire connector.

FIG. 3 shows the twist-on wire connector 10 partially in section revealing the injection port 15*a* with an injection tube 30 fitted to the end of the pipe nipple 15. In this example the interior cylindrical surface 30*b* of tube 30 forms a near interference fit with the external cylindrical surface 15*c* of the pipe nipple 15 to provide a passage 30*a* for injecting an expandable sealant such as foam type expandable insulation 25 therein. In this example the source of expandable sealant 25, which is injected through a finger operable nozzle 31, is located in a hand held pressurized container 33. One may activate the injection of the expandable sealant 25 by pushing on finger operable nozzle 31 although other methods of activation may be used without departing from the spirit and scope of the invention.

In the example of FIG. 3 the injection tube 30, which attaches to nozzle 31, is connected to the pipe nipple 15 to deliver the unexpanded sealant into the normally closed end of twist-on wire connector 10. In some instance the injection tube 30 may be used with wire connectors without an extra port. In such cases one extends the injection tube 30 into a wire end of the twist-on wire connector and proximate the wire junction to deliver the unexpanded sealant, typically in liquid form directly to the contact region between the wires. Once the unexpanded sealant is injected the person quickly removes the injection tube 30 and allows for the in situ expansion of the sealant around the electrical junction. Since the unexpanded sealant can be delivered deep into the wire connector and into the wire engagement area the radially outward expansion of the sealant forms a protective covering that grows outwardly from the injection site within the core of the wire connector thus allowing the expanding sealant to be used with wire connectors that may not have an inlet port for internal delivery of the unexpanded sealant.

Figure 3A:
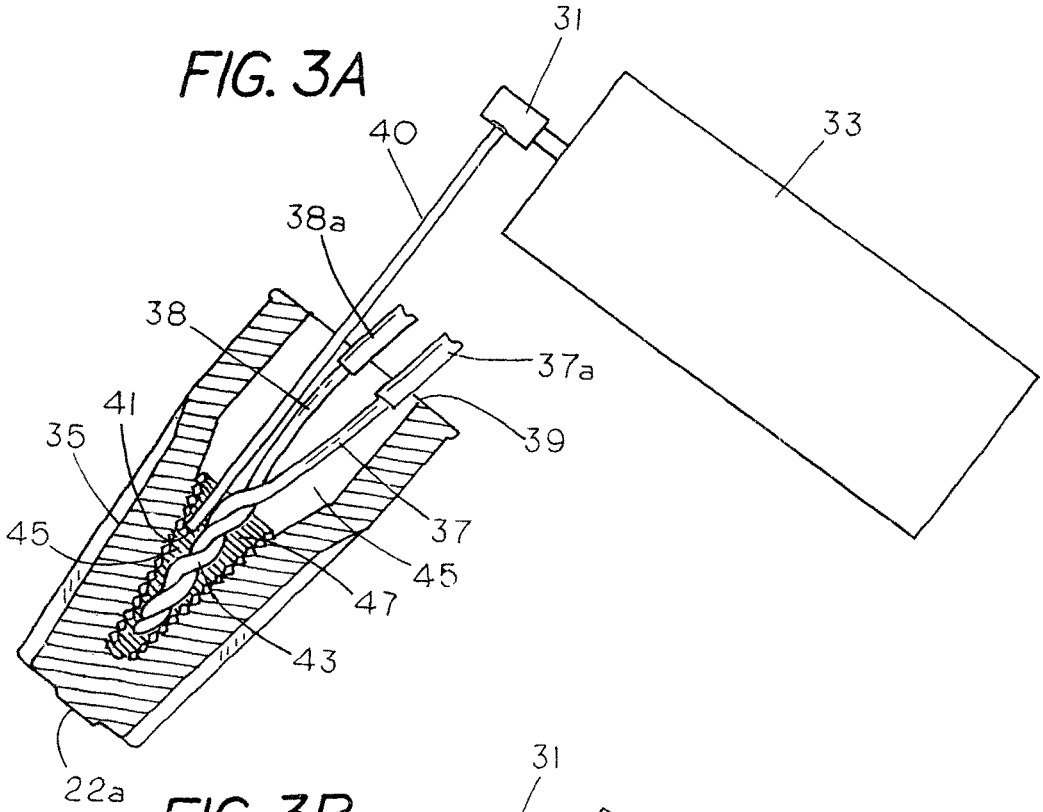
FIG. 3A is a partial sectional view showing the insertion of an expandable sealant directly into a region proximate an electrical connection located in a twist-on wire connector.

An example of delivery of unexpanded sealant in a first phase to a wire connector without an injection port is shown in FIG. 3A. FIG. 3A shows a twist-on wire connector 35 having an open wire end 39 with the opposite apex end 22*a* closed. The wire end 37 of wire 37*a* and the wire end 38 of wire 38*a* have been twisted into electrical engagement with each other to form a junction 43 which is located within the chamber 45 in spiral member 47. Once the wires are brought into electrical engagement with each other one can initiate the internal expansion of the sealant from within the wire connector 35. In this example the end 41 of an injection tube 40 connects to a nozzle 31 on a hand held pressurized container 33 containing an unexpanded sealant. The elongated injection tube 40 has in injection end 40*a* on order of the size of the wires that are in engagement with each other that allows one to place the injection end 40*a* in the region proximate the electrical connection to facilitate delivery of the unexpanded sealant directly to a region proximate the electrical junction 43, which is located within the spiral member 47. Once the expandable sealant is delivered one removes injection tube 40 and allows the expandable sealant therein to begin a phase change through an in situ internal expansion that encapsulates the electrical junction 43. The expanded sealant performs a dual function by first, protecting the electrical junction from the environment and secondly supporting and protecting the electrical junction from external forces that may dislodge the wires 38 and 39 from the twist-on wire connector 35. While it is preferred to use an injection end 41 having a dimension on the order of the wire sizes to deliver the unexpanded sealant directly to the region proximate the electrical junction one may use a larger diameter injection end 41 as long as the injection end 41 can deliver the unexpanded sealant in the first phase into the region proximate the electrical junction 43 within the wire connector 35. Preferably the injection end 41 should be able to fit within the wire end 39 of the wire connector when there are wires in engagement with each other in the chamber 45 of the of the wire connector 35.

While the invention has been shown and described with delivery of the expandable sealant to a region proximate the electrical connection to encapsulate the electrical connection the expandable sealant may also be used as an in situ self adhering waterproof plug that both conforms and adheres to the external surface of the electrical wires and the interior surface of the wire connector to form a protective cocoon around the electrical junction therein.

Figure 3B:
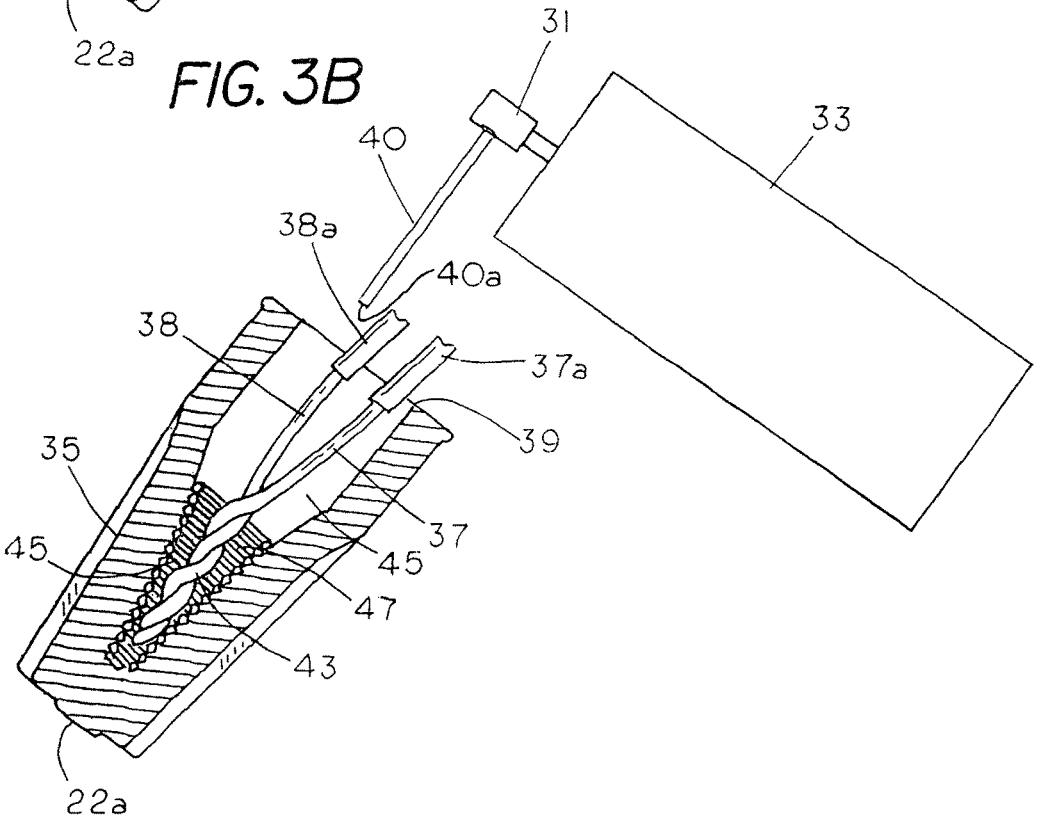
FIG. 3B is a partial sectional view showing the insertion of an expandable sealant directly into a wire end of a twist-on wire connector.

FIG. 3B is a partial sectional view showing the insertion of an expandable sealant 55 directly into a wire end 39 of a twist-on wire connector 35. In this example the nozzle end 40*a* of the elongated tube 40 is located at or near the wire end 39 of the twist-on wire connector 45. With the nozzle end 40*a* so positioned the expandable sealant is injected into the open wire end 39 of connector 35.

Figure 3C:
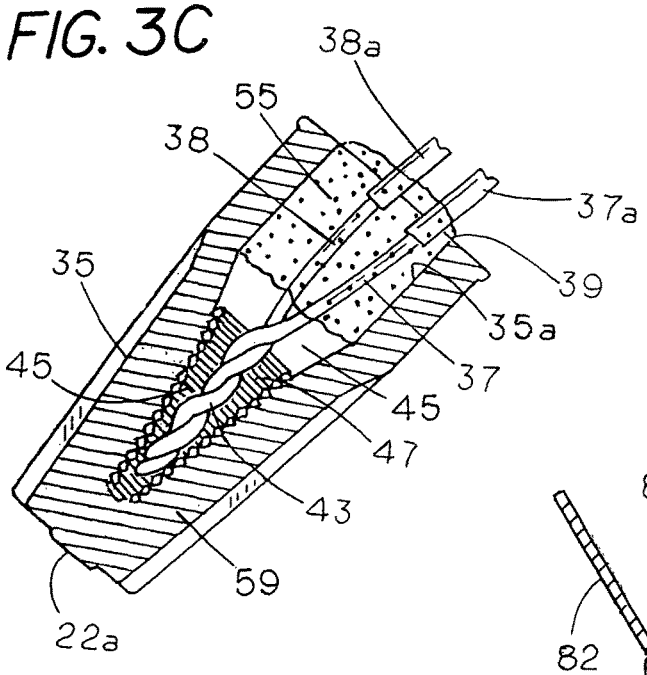
FIG. 3C is a partial sectional view showing the expandable foam forming a sealant plug at the end of the wire connector.

FIG. 3C is a partial sectional view of wire connector 35 showing the expandable sealant 55, which has been injected into the open wire end 39 to form an expanded sealant plug 55 that adheres to both the wires 37, 38 extending therethrough and an interior surface 35*a* of the wire connector 35. In this example the electrical connection is not in contact with the expanded sealant yet the electrical connection 43 is protected by a cocoon formed partially by the wire connector housing 59 and partially by the expanded sealant plug 55, which prevents moisture or other harmful environmental conditions from affecting the electrical connection 43 since the expanding sealant expands to tightly form a water resistant plug 55 that adheres to itself and the interior wall 35*a* of the wire connector and the wires 37, 38.

Figure 3D:
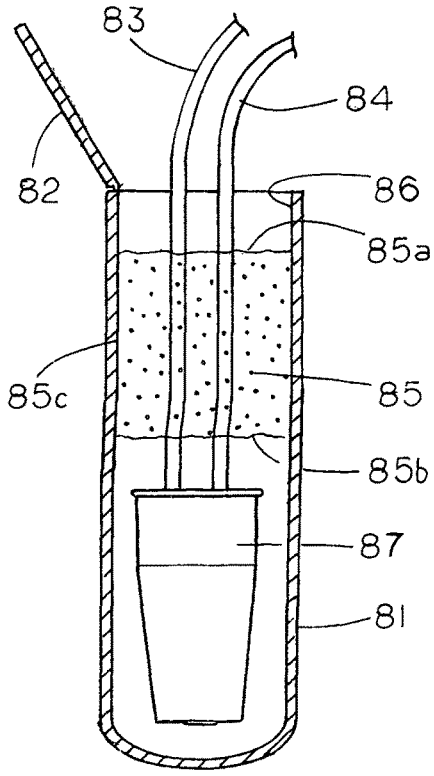
FIG. 3D is a partial sectional view showing the expandable sealant plug forming a waterproof plug in the end of a tubular housing.

FIG. 3D is a partial sectional view showing another example of an expandable sealant plug 85, which is used to seal a waterproof housing 81. In this example an electrical wire connector 87 having a set of joined electrical wires 83 and 84 is located in an elongated waterproof housing or tube 81 that includes a cover 82. Located at the open end of housing 81 and within the housing 81 is an expanded sealant plug 85 having a top surface 85*a* and a bottom surface 85*b* with electrical wires 83 and 84 extending through the sealant plug 85. The cylindrical wall 85*c* of the sealant plug 85 self adheres to the inner cylindrical wall 86 of the housing 81. In this example the radial pressure of the sealant plug 85 against wall 86 as well as the stickiness of the expanded sealant plug 85 coact to conform the shape of the sealant plug to the shape of the housing as the sealant plug 86 forms a waterproof seal between itself and the sidewall 86 to prevent moisture from entering into the wire connector and the wire connection therein. Thus, a wide variety of wire connectors may be rendered waterproof by either forming a sealant plug in a wire end of a wire connector or by cocooning a wire connector within a water proof housing. While FIG. 3D shows the wire connector 80 located below an expanded sealant plug alternately one may fill the entire tube 81 with the expanded sealant 85 so that the entire electrical connector 80 is encapsulated by the expanded sealant.

Figure 4:
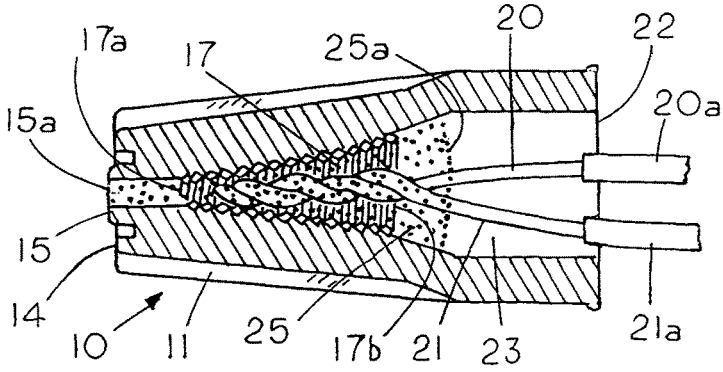
FIG. 4 is a cross section view of FIG. 2 with an expandable sealant located in an unexpanded condition proximate an electrical connection.

FIG. 4 shows a cross sectional view of the twist-on wire connector 10 after the expandable sealant 25 has been injected into the twist-on wire connector 10 and before the expandable sealant has begun to expand. As can be seen in FIG. 4 the sealant, which is in the first phase, forms a sealant air interface 25*a* that separates the sealant 25 in an unexpanded state from the interior portion of the twist-on wire connector, which is free of sealant. As can be seen the sealant 25 extends both inward from pipe nipple 15 and outward toward the flared end 17*b* of the spiral coil with the wires 20 and 21 extending through the sealant air interface 25*a*. A feature of the invention is that the expandable sealant 25 can be injected from a normally closed spiral top end or apex end 17*e* thereby insuring that expandable sealant fills the top or apex end 17*e* of wire connector without creating gaps around the wires. Once the expandable sealant is injected the source 33 of expandable sealant can be removed from the inlet port 15*a*. During the following in situ expansion of the sealant air can be forced out the wire end 22 as well as the inlet port 15*a*. In this example the increase in the cross sectional area of cavity 23 from the apex end 17*e* of the spiral member 17 to the flared end 17*b* ensures that the in situ expandable sealant has room to expand, without forming gaps as the expandable sealant can both flow fill and expand toward the open wire end 22.

Figure 4A:
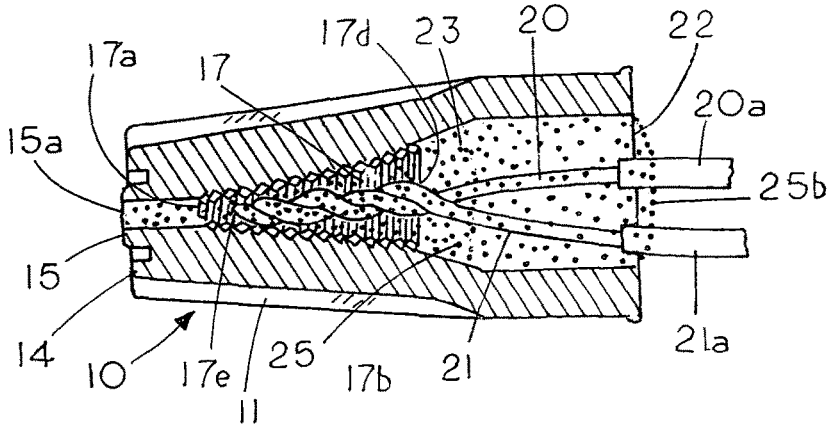
FIG. 4A is a cross section view of the FIG. 2 with an expanded sealant surrounding the electrical connection.

FIG. 4A shows a cross sectional view of the twist-on wire connector 10 in the second phase after the in situ expansion of the expandable sealant 25. In this example the internal volume 23 of the twist-on wire connector 10 includes the expanded sealant 25, which extends around the wires 20 and 21 with a sealant air interface 25*b* located external to the twist-on wire connector 10. The in situ internal expansion of the expandable sealant 25 within the wire connector fills the normally closed end of the wire connector 10 as it forces itself toward the open or wire end 22 to thereby provide a protective covering over the electrical junction 27 within the wire connector 10 with the bared wire ends 20 and 21 located behind the air sealant interface 25*b* as well as encapsulated in the expanded solidified sealant 25.

A reference to FIG. 3 shows an electrical junction encapsulation kit 29 comprising a twist-on wire connector 10 having an electrically insulated housing 11 and a reference to FIG. 4 and FIG. 4A show housing 11 having a cavity 23 therein. Wire connector 10 includes an apex end 14 of the housing 11 having a pipe nipple 15 with a fluid injection port 15*a* therein and an opposite end of the housing having an open wire end 22 larger than the fluid injection port 15*a*. The injection port 15*a* connecting to a fluid passage 17*a* in an apex end 17*e* of the spiral member 17 in the twist-on wire connector 10. As shown the open wire end 22 forms a wire access port on an opposite end of the cavity 23 in the twist-on wire connector.

The spiral coil 17 is mechanically or adhesively secured to the electrically insulated housing 11 and has a flared base end 17*b* with a wire opening 17*d* and an apex end 17*e*. The apex end 17*e* of the spiral coil 17 includes a fluid passage 17*a* therein that is in fluid communication with the injection port 15*a*. In this example the opening in the base end 17*b* is large enough to receive a plurality of electrical wires to be joined in an electrical connection within the spiral coil 17 in the electrically insulated housing through twisting of the twist-on wire connector 10 with respect to the plurality of wires 20, 21 that are to be electrically joined within the twist-on wire connector. Also in this example the fluid passage 17*a* in the apex end 17*e* of the spiral coil 17 is small enough to prevent accidental insertion of the plurality of electrical wires through the fluid passage 17*a* in the apex end 17*e* of the spiral coil 17.

Located proximate the wire connector 10 is a source of expandable electrically insulative sealant 33 for in situ solidification within the spiral coil 17 with expandable insulative sealant stickingly adhereable to an interior surface of the wire connector when in either a fluid state or a solid state. Once the expandable insulative sealant expands the spiral coil 17 and the plurality of electrical wires are lockable secured to the spiral coil through in situ expansion of expandable insulative sealant 33 from a liquid state to an expanded and solidified condition.

The kit 29 includes a nozzle 31 connected to a pressurized source of expandable sealant 33, which is in an unexpanded state. An injection tube 30 having a first end connected to the source of expandable sealant 33 and an opposite end comprising an injection end 30*c* which is temporarily attachable to pipe nipple 15 of the twist-on wire connector so that a release of the expandable sealant 25 in liquid from the nozzle 31 flows in an unexpanded viscous condition through the injection port 15*a* and into proximity of the plurality of wires 20, 21 which are in engagement with the spiral coil 17 in the electrical insulated housing 11. Once in position the expandable sealant 25 comes into air contact and through an in situ expansion solidifies to maintain the plurality of wires 20, 21 and the spiral coil 17 in shielded engagement with each other as well as shielding the electrical connection from a hostile environment proximate the twist-on wire connector.

In this example the injection tube 30 is larger than the injection port 15 and is frictionally engageable with the pipe nipple 15 for directing expandable sealant 25 from the source of expandable sealant 33 into the cavity of the twist-on wire connector.

The expandable sealant is preferably a closed cell foam sealant wherein the exterior cell surfaces from intimate contact with the surfaces they are in contact with to prevent moisture penetration, however, other types of expandable sealants may be used without departing from the spirit and scope of the invention.

As can be seen in FIG. 3 the electrical junction encapsulation kit 29 maintains the expandable sealant 25 in a pressurized hand holdable container 33 with a finger operable nozzle 31 for delivery of unexpanded sealant directly to an internal region proximate an electrical connection within the electrical wire connector 10.

In the examples of the invention described herein it is preferred to use an electrically insulative expanding foam sealant such as a polymeric foam that has electrical insulation qualities as well as water resistant qualities. Typical expanding foam sealants are used for repairing cracks or gaps in buildings by filling the crack or gap with the sealant. The known sealants include polyurethane sealants that can be injected into building cracks or gaps and once injected the sealant expands and cures to a rigid or semi-rigid state thereby filling the crack. Examples of foam sealants sold in pressurized containers is Foam & Fill sold by Red Devil, Inc. Other examples include liquids that can be mixed and then injected. One such expanding sealant is sold by Aero Marine Products of San Diego Calif. 92121. While expandable closed cell electrically insulative foam sealants are preferred in certain applications one may use expandable open cell sealant and in some cases one may use other types of in situ expandable electrically insulative sealants to maintaining electrical connection while forming a waterproof seal around the electrical junction.

Figure 5:
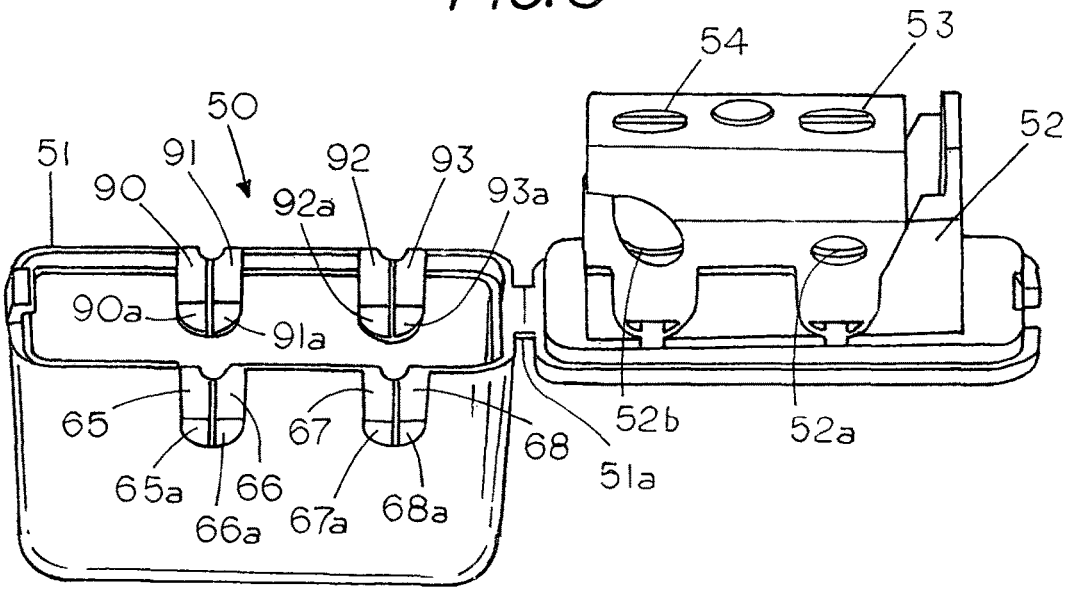
FIG. 5 is an electrical wire connector having a housing with a lug type connector in an open condition.

FIG. 5 shows an example of another type of connector 50 having a hinged cover 51 that can be folded around a wire connector or lug 52 having a first wire port 52*a* and a second wire port 52*b*. In this example a screw 53 can be rotated against a wire located in port 52*a* to form an electrical connection between the wire connector 52 and the wire in port 52*a*. Similarly, a screw 54 can be rotated against a wire located in port 52*b* to form an electrical connection between the wire connector 52 and the wire in port 52*a*. In this example cover 51 includes a living hinge 51*a* for placing the housing cover over the wire connector, however, the cover could be separate or other types of hinges may be used without departing from the spirit and scope of the invention.

The housing 51 comprises an open sided shell having a set of side passages that are formed by flaps that are integrally formed in the housing 51 to enable the housing 51 to be closed around the wire connector 52 with the wires extending outward from the wire connector. A reference to FIG. 5 shows that on one side there is a first set of four integral flaps 65, 65*a*, 66 and 66*a* for a first wire 62 and a second set of integral flaps 67, 67*a*, 68 and 68*a* for a second wire. In this example the the opposite side of housing 51 includes third a set of integral flaps 90, 90*a*, 91*a* and 91 for a third wire and a fourth set of integral flaps 92,92*a* 93*a* and 93 for a fourth wire. Each of the flaps are in a normally closed condition until forced to an open condition by insertion of the wire therein.

Figure 5A:
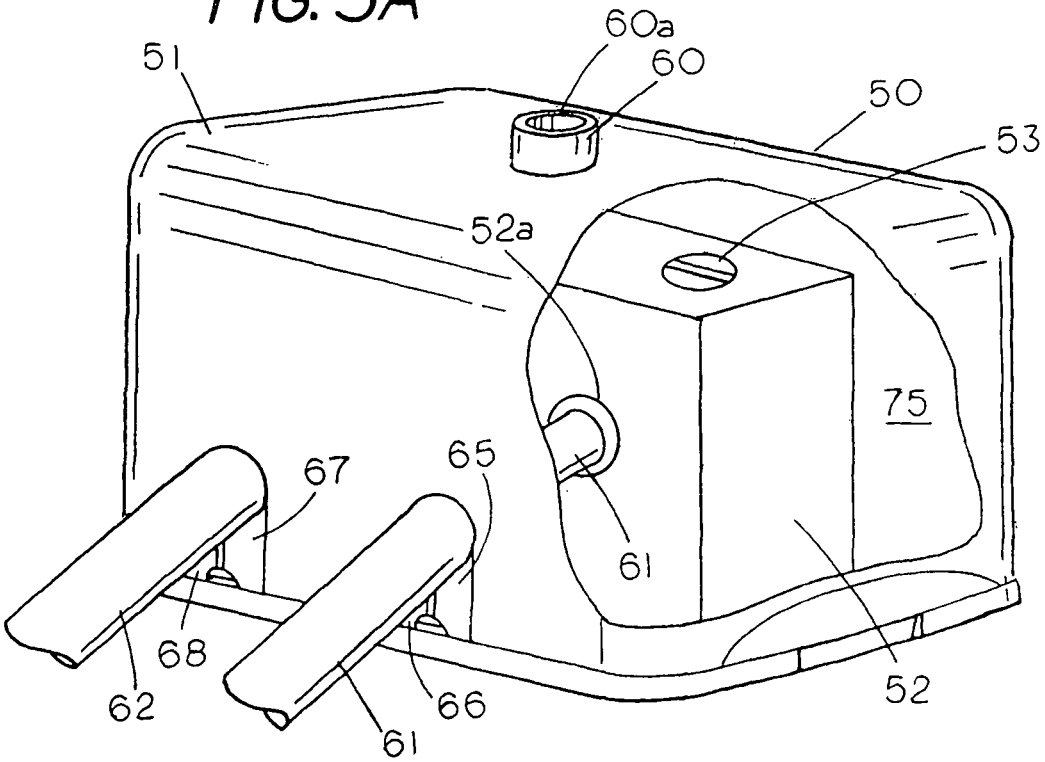
FIG. 5A is a partial cutaway view of connector of FIG. 5 with no expandable sealant therein.

FIG. 5A shows the wire connector 50 partially in section to reveal a first wire 62 and a second wire 61 extended through the integral flaps on the side of housing 50. As shown wire 61 extends into the wire port 52*a* in wire connector 52 and wire 62 extends into port 52*b* (see FIG. 5A). Located on a top side of housing 50 is a pipe nipple 60 having a central passage 60*a* that extends through the housing 50 to form a sealant flow path through the housing 50 and into the cavity or chamber 75. In this condition the wires 61 and 62 have been attached to the wire connector 52 and are in a ready condition for transmission of electrical current therethrough.

Figure 6:
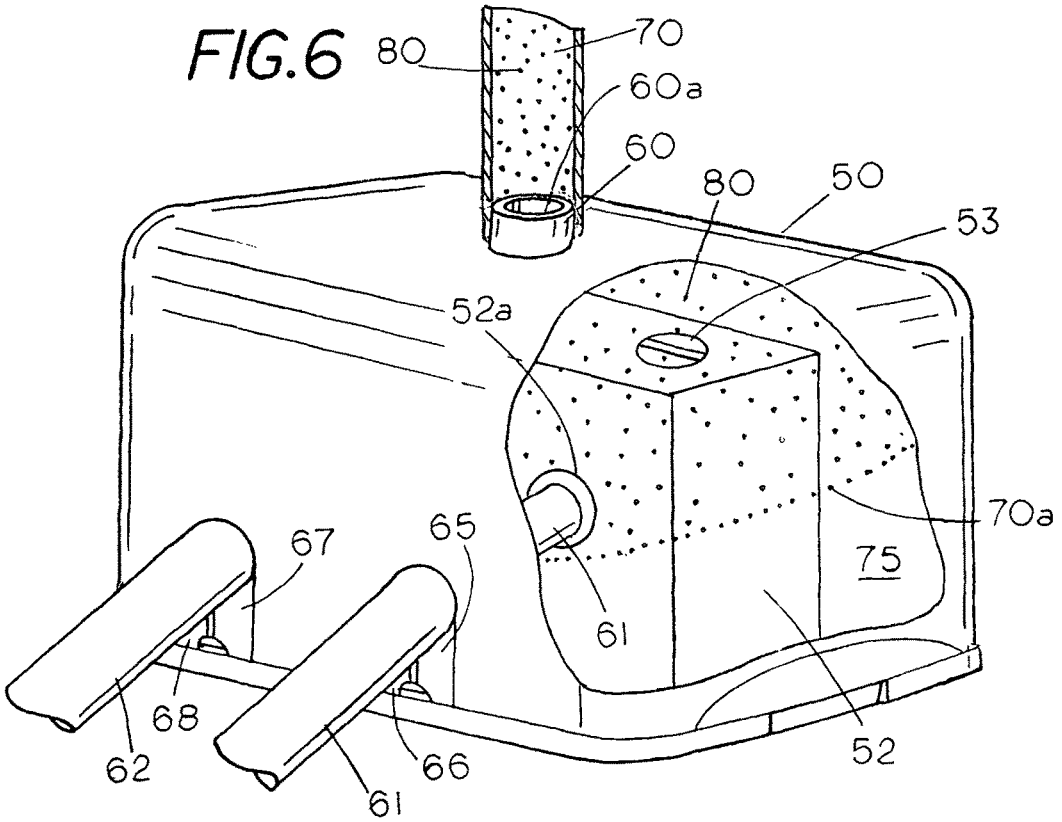
FIG. 6 is the partial cutaway of FIG. 5 with the expandable sealant in a partially expanded state.

FIG. 6 shows the wire connector 50 with a tube 70, which is connected to a source of expandable sealant in engagement with pipe nipple 60 to provide a sealant flow path through tube 70 and into a chamber 75 within the housing 51. In this example an expandable sealant 80 in an unexpanded condition has been injected into the chamber 75 in the wire connector. Immediately after injection but before complete expansion of the expandable sealant the expandable sealant 80 forms an air sealant interface 70*a* with the expandable sealant extending at least partially over the wire lug 52.

Figure 7:
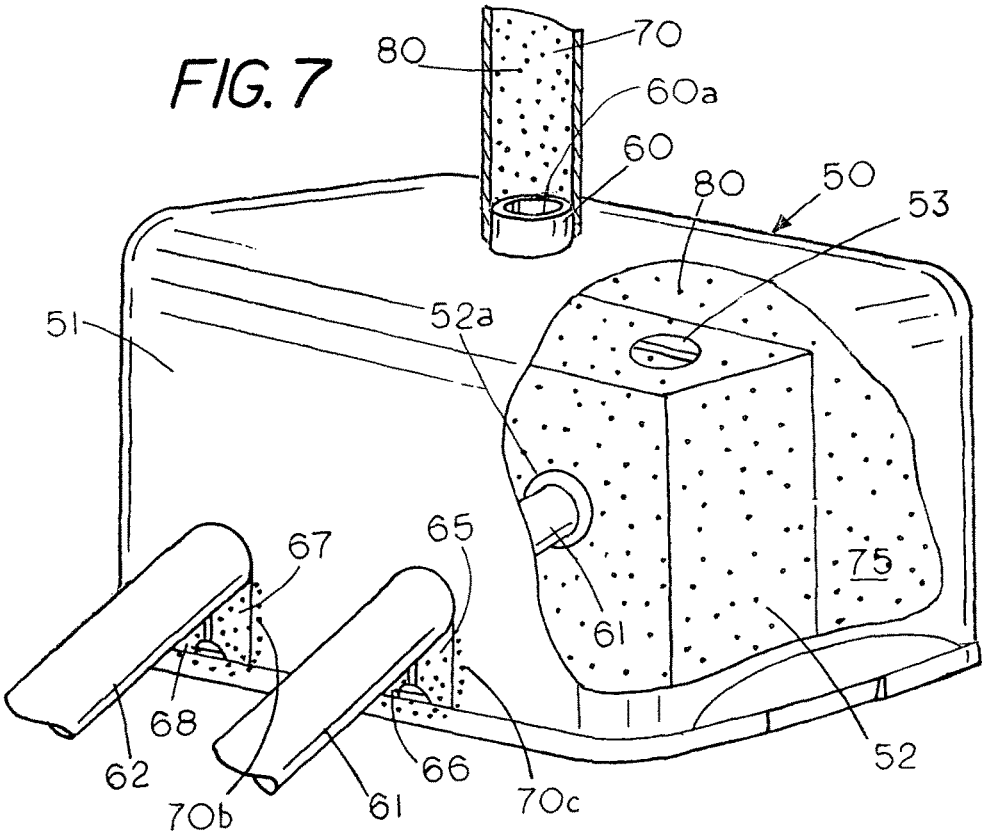
FIG. 7 is a partial cutaway view of the wire connector of FIG. 5 with an in situ expandable sealant in an expanded state.

While FIG. 6 shows the expandable sealant 80 in an unexpanded state a reference to FIG. 7 shows the expandable sealant 80 in an expanded condition. In this condition the sealant 80, which is shown in FIG. 6, has undergone an internal in situ expansion to encapsulate and enclose lug 52 from within the housing 51. As the expandable sealant 80 expands it forces air, which is present in the housing 51 of the wire connector 50, out of cavity 75 through the flaps 67, 68 located around wire 62 and flaps 65, 66 located around the wire 61. Thus, in this embodiment the expandable sealant 80 undergoes an in situ internal expansion that fills the housing chamber 75 with a sealant as air within the housing is forced outward from the housing 51 through either the port 60*a* or the openings in housing 51 which are proximate wires 61 and 62. The internal in situ expansion of the sealant within the chamber 75 eliminating or minimizing the chance of voids or gaps being formed around the connector lug 52 thus ensuring that a wire junction in lug 52 is protected from the environment without the presence of gaps around the lug 52.

Figure 5B:
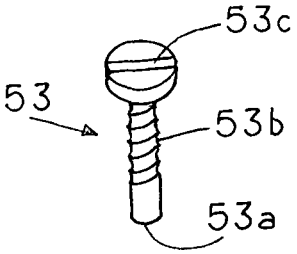
FIG. 5B is an isolated view of a terminal screw.

A method of the present invention is shown in use with a non twist-on wire connector, and is illustrated in FIGS. 5 to 7. The method includes the steps of forming and waterproofing an electrical junction in an electrically conductive wire lug 52 that is located within a wire connector 50 where the lug includes a pair of identical terminal screws 54 and 53 one of which is shown in isolated view in FIG. 5B. Screw 53*a* comprise a slotted head 53*c*, a thread 53*b* and a screw end 53*a* for forming electrical contact with an electrical wire through rotation of screw 53 as other portions of the screw form electrical contact with the lug 52. While terminal screws are shown other methods of electrically securing the electrical wire to the lug 52 or to each other may be used without departing from the spirit and scope of the invention.

In this example one joins a first electrical wire 61 and a second electrical wire 62 into an electrical connection in a metal electrically conductive lug 52 having a wire port 52*a* and a screw 53 having an end 53*a* by rotating screw 53 into electrical engagement with a first wire 61 in a wire port 52*a* and by rotating a screw 54 also having an end into electrical engagement with a second wire 62 in a wire port 52*b*. This step completes the formation of an electrical connection between wires 62 and 63 through the electrically conductive metal lug 52.

In the next step one forms an air chamber 75 proximate the lug 52 by placing an electrically insulative housing 51 in a spaced condition from the lug 52 with the first wire 61 and the second wire 62 extending through the electrically insulative housing 61 as shown in FIG. 5A. One can then attach a source of an expandable sealant 33 to an inlet port 60*a* in the housing with the inlet port located on a one side of the housing 61. Once connected as shown in FIG. 6 one directs the expandable sealant 80, which is in an unexpanded condition, into the inlet port 60*a* from the source of expandable sealant 33. Next, one maintains the source of expandable sealant connected to the inlet port 60*a* as an in situ expansion of the expanding sealant 80 simultaneously encapsulates the lug 32 and forces air out of the air chamber 75. Once the expanding sealant solidifies one removes the source of expandable sealant 33 from the inlet port 60*a* leaving a weather protected electrical connection therein.

FIG. 6 shows the step of temporarily attaching the source of expandable sealant 33 to a pipe nipple 60 on the housing 51 to allow one to inject sufficient expandable sealant 80 in an unexpanded condition through the pipe nipple 60 and into the air chamber 75 from the source of expanding sealant 33. FIG. 6 shows the air chamber 75 partially filled with sealant and in condition for an in situ expansion and solidification of the sealant. FIG. 7 shows that after the expansion and solidification of the sealant 80 the sealant expands outward from the housing 51 through a first exhaust port formed by an outward deflection of a first set of integral flaps 67, 68 to thereby form a first air sealant interface 70*b* on the outside of connector and outward from the housing 51. In this case the flaps maintain the sealant within the housing as well as provide resistance to sealant expansion ensuring that the sealant will first expand within the air chamber 75. Similarly, the sealant 80 expands outward through a second exhaust port formed by an outward deflection of a second set of integral flaps 65, 66 to form a second air sealant interface 70*c* on the outside of connector 50. In this example the first air sealant interface 70*b* and the second air sealant interface 70 in conjunction with the expanded sealant 80 in the interior of housing 51 prevent moisture from entering the wire connector 50 around either the first wire 61 or the second wire 62.

Although an expandable foam sealant is preferred it is envisioned that other in situ expandable sealants may be used without departing from the spirit and scope of the invention.

While the invention has been shown with a twist-on wire connectors and a lug connector having inlet ports other types of wire connectors may be used for receiving an expandable sealant. That is a wire connector without an inlet port on a first side of the electrical and a wire port on another side of the housing may be used to receive an expandable sealant with in situ internally expanding sealant encapsulating the electrical connector within the housing of the electrical connector.

Thus a feature of the invention described herein is the protecting of an electrical connection can be done on-the-go and in the field to enable a person to quickly protect an electrical junction from exposure to the environment, which makes the invention an important tool in the irrigation field where electrical connections are often located in hostile environments and are done on-the-go and in the field.

We claim:

1. An electrical junction encapsulation kit comprising:

a twist-on wire connector having an electrically insulated housing having a cavity therein with a closed end of the housing having a pipe nipple with a fluid injection port therein and an opposite end of the housing having an open wire end larger than the fluid injection port with the injection port forming a fluid passage in an apex end of the cavity in the twist-on wire connector and the open wire end forming a wire access port to an opposite end of the cavity in the twist-on wire connector;

a spiral coil located in the cavity and secured to said electrically insulated housing, said spiral coil having a flared base end with a wire opening and an apex end on the opposite end of the spiral coil with the apex end of the spiral coil having a fluid passage therein in fluid communication with the injection port with the wire opening in the base end large enough to receive a plurality of electrical wires to be joined in an electrical connection within the spiral coil in the electrically insulated housing through twisting of the twist-on wire connector with respect to the plurality of wires to be electrically joined within the twist-on wire connector with the fluid passage in the apex end of the spiral coil small enough to prevent insertion of the plurality of electrical wires through the fluid passage in the apex end of the spiral coil;

a source of expandable electrically insulative sealant for in situ solidification within the spiral coil, said expandable insulative sealant stickingly adhereable to an interior surface of the wire connector when in either a fluid state or a solid state, the spiral coil and the plurality of electrical wires lockable securable to the spiral coil through an in situ expansion of expandable electrically insulative sealant from a liquid to an expanded and a solidified condition, said expandable insulative sealant in a pressurized hand holdable container;

a finger operable nozzle connected to the pressurized hand holdable container for delivery of the unexpanded foam sealant to an internal region proximate an electrical connection within an electrical wire connector; and an injection tube having a first end connected to the pressurized hand holdable container and an injection end temporarily attachable to the pipe nipple of the twist-on wire connector wherein a release of the expandable sealant in the liquid flows from the nozzle in an unexpanded condition and a viscous condition through the injection port and into proximity of the plurality of wires in engagement with the spiral coil in the electrical insulated housing to where the expandable sealant forms the in situ expansion and the solidification to maintain the plurality of wires and the spiral coil in shielded engagement with each other and to shield the electrical connection therein from a hostile environment proximate the twist-on wire connector.

2. The electrical junction encapsulation kit of claim 1 wherein the injection tube is larger than the injection port and frictionally engageable with the pipe nipple for directing the expandable sealant from the pressurized hand holdable container of the expandable foam sealant to the cavity of the twist-on wire connector.

3. The electrical junction encapsulation kit of claim 2 wherein the expandable sealant is a closed cell foam sealant.

4. A waterproof wire connector comprising;

an electrical wire connector having a housing with at least one opening;

an electrical wire connection located in said electrical wire connector;

an expanded sealant located in the electrical wire connector with the expanded sealant proximate the electrical connection formed through an expandable sealant phase change and an internal in situ expansion of an the expandable sealant within the wire connector with at least one electrical wire extending through the expanded sealant and the electrical wire connector housing, said expanded sealant having a sealant-air interface located external to the housing with the expanded sealant forming a rigid or semi rigid covering to protect the electrical wire connection therein;

wherein the expanded sealant comprise and expandable foam sealant that is spaced from the junction of the electrical wire connection to form a sealant plug to an end of the wire connector; and wherein the electrical wire connection includes electrical wires that extend through the expanded sealant with an exterior cylindrical surface of the electrical wires adhered to the sealant though an in situ expansion of the expandable sealant to form a waterproof joint therebetween.

5. The waterproof wire connector of claim 4 wherein the electrical wire connector is a twist-on wire connector.

6. The waterproof wire connector of claim 4 wherein the waterproof housing comprises an elongated tube and the semi or semi rigid covering with the expanded sealant comprising an expanded foam sealant.

7. The waterproofed wire connector of claim 4 wherein the electrical wire connector is a lug connector with an electrically insulative housing thereon.

8. The waterproof wire connector of claim 4 wherein the sealant stickingly adheres to a sidewall of the housing after expanding to restrain the sealant from movement as well as to provide a water tight seal between the sealant and the sidewall of the housing by an elimination of gaps through an in situ expansion of the expandable sealant within the wire connector.

* * * * *